US012617502B2

(12) United States Patent
L'Heureux et al.

(10) Patent No.: US 12,617,502 B2
(45) Date of Patent: May 5, 2026

(54) FENDER FOR WATERCRAFT

(71) Applicant: BOMBARDIER RECREATIONAL PRODUCTS INC., Valcourt (CA)

(72) Inventors: Marc-Andre L'Heureux, Bromont (CA); Abdelkarim Meskine, Valcourt (CA); Mathieu Hamel-Gagnon, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 378 days.

(21) Appl. No.: 18/498,769

(22) Filed: Oct. 31, 2023

(65) Prior Publication Data

US 2025/0136255 A1 May 1, 2025

(51) Int. Cl.
*B63B 59/02* (2006.01)
*B63B 34/10* (2020.01)

(52) U.S. Cl.
CPC ..... *B63B 59/02* (2013.01); *B63B 34/10* (2020.02)

(58) Field of Classification Search
CPC ... B60D 99/00; F16B 3/00; F16B 5/00; F16B 7/00; F16B 12/00; F16B 21/00; B63B 59/10; B63B 59/02
See application file for complete search history.

(56) References Cited

U.S. PATENT DOCUMENTS 4,893,576 A 1/1990 Day et al.
4,895,094 A 1/1990 Carlstedt
4,915,662 A 4/1990 Kent
4,946,727 A 8/1990 Kessler
4,998,495 A 3/1991 Bos et al.
5,013,272 A 5/1991 Watkins
5,013,596 A 5/1991 Kessler
D318,312 S 7/1991 Watkins
5,027,736 A 7/1991 Drews
5,096,753 A 3/1992 Cue et al.
5,152,245 A 10/1992 Olsen
5,220,879 A 6/1993 Johnson
(Continued)

FOREIGN PATENT DOCUMENTS

AU 2021106515 A4 11/2021
DE 3706918 A1 9/1988
(Continued)

OTHER PUBLICATIONS https://pwcsuperrack.com/en-ca/products/new-item-go-pro-bracket-for-2018-2020-seadoo-gtx-rxtx-free-shipping, retrieved from the internet on Jul. 11, 2024.
(Continued)

*Primary Examiner* — Timothy D Collins
(74) *Attorney, Agent, or Firm* — BCF LLP

(57) ABSTRACT

A fender for a watercraft having a watercraft body. The watercraft body defines an aperture. The fender has: a fender body; an anchor distinct from the fender body, the anchor being configured to be inserted in the aperture defined in the watercraft body and for selectively connecting the fender to the watercraft body; and a link distinct from the fender body and from the anchor, the link connecting the fender body to the anchor. The fender body is made from a flexible material. The anchor is made from a rigid material. The link is made from a resilient material. A watercraft having the fender is also disclosed.

21 Claims, 12 Drawing Sheets

(56) References Cited

U.S. PATENT DOCUMENTS

| | | | |
|---|---|---|---|
| 5,247,897 | A | 9/1993 | Pepp |
| 5,269,248 | A | 12/1993 | Lee |
| 5,299,521 | A | 4/1994 | Loucks |
| 5,355,822 | A | 10/1994 | Lemke |
| 5,484,240 | A | 1/1996 | Rosenberg |
| 5,730,077 | A | 3/1998 | Nunes et al. |
| 5,743,204 | A | 4/1998 | Tweet |
| 5,762,019 | A | 6/1998 | O'Rourke et al. |
| 5,832,857 | A | 11/1998 | McPherson |
| 5,836,134 | A | 11/1998 | Couto et al. |
| 5,845,585 | A | 12/1998 | Meeus et al. |
| 5,845,885 | A | 12/1998 | Carnevali |
| 5,957,073 | A | 9/1999 | Kerber et al. |
| 6,021,729 | A | 2/2000 | DeRuscio |
| 6,050,211 | A | 4/2000 | Yamaguchi |
| 6,152,060 | A | 11/2000 | Steiner |
| 6,187,420 | B1 | 2/2001 | Tajima et al. |
| 6,289,835 | B1 | 9/2001 | Silberman |
| 6,332,421 | B1 | 12/2001 | Leonard et al. |
| 6,357,377 | B1 | 3/2002 | Santelli, Jr. |
| 6,364,293 | B1 | 4/2002 | Beckett |
| 6,470,819 | B2 | 10/2002 | Silberman |
| 6,477,973 | B1 | 11/2002 | Kobas |
| 6,752,098 | B2 | 6/2004 | Skulnick |
| 6,758,156 | B1 | 7/2004 | Kobas |
| 6,863,011 | B2 | 3/2005 | Kinkead |
| 6,948,440 | B2 | 9/2005 | Aschenbach |
| D511,723 | S | 11/2005 | Kobas |
| 6,983,711 | B1 | 1/2006 | Lemke |
| 7,090,181 | B2 | 8/2006 | Biba |
| 7,143,714 | B1 | 12/2006 | Schmidt |
| 7,293,518 | B1 | 11/2007 | Gassew |
| D557,652 | S | 12/2007 | Gassew |
| 7,320,450 | B2 | 1/2008 | Carnevali |
| 7,398,952 | B2 | 7/2008 | Carnevali |
| D578,464 | S | 10/2008 | Sheedy et al. |
| 7,430,978 | B2 | 10/2008 | Rezzonico |
| 7,448,338 | B2 | 11/2008 | Steward et al. |
| 7,461,826 | B2 | 12/2008 | Carnevali |
| 7,509,920 | B2 | 3/2009 | Taylor |
| 7,523,904 | B2 | 4/2009 | Carnevali |
| 7,594,631 | B1 | 9/2009 | Carnevali |
| 7,594,633 | B2 | 9/2009 | Carnevali |
| 7,624,694 | B2 | 12/2009 | Aschenbach |
| 7,802,768 | B2 | 9/2010 | Carnevali |
| 7,850,133 | B2 | 12/2010 | Carnevali |
| RE42,060 | E | 1/2011 | Carnevali |
| 7,954,773 | B2 | 6/2011 | Carnevali |
| RE42,581 | E | 8/2011 | Carnevali |
| 8,150,248 | B1 | 4/2012 | Woodman |
| RE43,806 | E | 11/2012 | Carnevali |
| 8,590,855 | B2 | 11/2013 | Carnevali |
| 8,875,830 | B2 | 11/2014 | Massicotte et al. |
| 9,180,925 | B2 | 11/2015 | Carnevali |
| 9,206,827 | B2 | 12/2015 | Loree et al. |
| 9,365,268 | B1 | 6/2016 | Paccoud et al. |
| 9,371,041 | B2 | 6/2016 | Almhill et al. |
| 9,372,041 | B1 | 6/2016 | Geissele |
| 9,389,491 | B2 | 7/2016 | Clearman et al. |
| D764,566 | S | 8/2016 | Bennett et al. |
| D764,567 | S | 8/2016 | Bennett et al. |
| D771,734 | S | 11/2016 | Samuels et al. |
| 9,482,931 | B1 | 11/2016 | Clearman et al. |
| 9,505,335 | B2 | 11/2016 | Massicotte et al. |
| D776,745 | S | 1/2017 | Bennett et al. |
| D785,074 | S | 4/2017 | Woodman et al. |
| 9,612,507 | B2 | 4/2017 | Woodman et al. |
| 9,725,142 | B2 | 8/2017 | Glass |
| D800,207 | S | 10/2017 | Harisson et al. |
| D800,819 | S | 10/2017 | Parfitt et al. |
| D800,823 | S | 10/2017 | Druker et al. |
| 9,930,231 | B2 | 3/2018 | Clearman et al. |
| 10,025,166 | B2 | 7/2018 | Clearman |
| D831,099 | S | 10/2018 | Paterson et al. |
| D869,546 | S | 12/2019 | Paterson et al. |
| 10,599,020 | B2 | 3/2020 | Druker et al. |
| D893,582 | S | 8/2020 | Vitale et al. |
| D897,415 | S | 9/2020 | Muhlenkamp, IV et al. |
| D921,095 | S | 6/2021 | Alberstein et al. |
| RE49,005 | E | 4/2022 | Bergman et al. |
| 11,738,833 | B1 | 8/2023 | Morin-Savard et al. |
| 2003/0217684 | A1 | 11/2003 | Chaffee |
| 2008/0087785 | A1 | 4/2008 | Roche |
| 2010/0031862 | A1 | 2/2010 | Powell et al. |
| 2010/0264287 | A1* | 10/2010 | Rosemann et al. ... F16B 21/073 248/316.7 |
| 2017/0127867 | A1 | 5/2017 | Malott et al. |
| 2018/0222396 | A1 | 8/2018 | Binder et al. |
| 2019/0031110 | A1 | 1/2019 | Cha et al. |
| 2020/0307720 | A1 | 10/2020 | Fischer et al. |

FOREIGN PATENT DOCUMENTS

| | | | | |
|---|---|---|---|---|
| EP | 0429107 | B1 | 4/1994 | |
| EP | 0827904 | B1 | 3/1998 | |
| EP | 0987176 | A2 | 3/2000 | |
| FR | 2785865 | A1 | 5/2000 | |
| GB | 2388078 | B | 3/2005 | |
| GB | 2435014 | A | 8/2007 | |
| NZ | 502980 | A * | 9/2002 | ..... E02B 3/26 |
| WO | 2001020082 | A1 | 3/2001 | |
| WO | 2004033285 | A1 | 4/2004 | |
| WO | 2004076749 | A1 | 9/2004 | |

OTHER PUBLICATIONS

BRP Inc.; Cup Holder Installation Instructions.

BRP Inc.; LinQ Lite Action Camera Holder; retrieved from https://sea-doo-shop.brp.com/ca/en/295101139-linq-lite-action-camera-holder.htlm on Oct. 16, 2024.

BRP Inc.; LinQ Lite Fenders; retrieved from https://sea-doo-shop.brp.com/ca/en/295101138-linq-lite-fenders.htlm on Oct. 16, 2024.

BRP Inc.; Snap-in Fenders; retrieved from https://sea-doo-shop.brp.com/ca/en/295100418-snap-in-fenders.htlm on Oct. 16, 2024.

BRP Inc.; Splash by SEA-DOO—The 2022 Sea-Doo LineUp is Here; Issue No. 1; Cover pages and pp. 14, 15, 19, 22 to 27, 29 and 55.

International Preliminary Report on Patentability of PCT/IB2022/057430; Jan. 18, 2024; Nathan Newhouse.

Revised Version (A9) of International Search Report of PCT/IB2022/057430; Nov. 18, 2022.

YouTube; Cup/Rod Holder Sea-Doo—How to Install; Mar. 21, 2021; retrieved from https://www.youtube.com/watch?v=9_DKNmj7zWE on Oct. 16, 2024.

https://yamaha-motor.com/p/yamaha-waverunner-r-fender, retrieved from the internet on Nov. 1, 2023.

* cited by examiner

FENDER FOR WATERCRAFT

CROSS-REFERENCE

None

TECHNICAL FIELD

The present technology relates to fenders for watercraft and to watercraft having fenders.

BACKGROUND

Fenders are used on all kinds of watercraft to protect the hull and/or deck from damage caused by collisions, such as collisions with a dock or another boat when the watercraft is at rest. Some fenders are permanently installed on the watercraft. Usually, however, the fenders are only deployed when needed.

A personal watercraft (PWC) is typically provided with two fenders that are kept in the storage compartment of the PWC until needed. Prior to arriving at a dock, the fenders are taken out and installed along the side facing the dock, usually one in the front portion and one at the rear portion of the PWC. When the PWC leaves the dock, the fenders are removed and once again stowed away.

On a boat or larger watercraft, fenders are typically suspended over the side of the hull from a railing or another structure. A rope or strap is commonly used to attach the fender to the structure from which it is suspended.

On the other hand, the options for attaching fenders to smaller watercraft, such as a PWC, are limited because of their compact dimensions and construction. For PWCs in particular, fenders are sometimes tied to a tow eye at the vessel's rear. In the front portion of a PWC, a fender is sometimes retained by closing the hatch down on a strap or rope attached to the fender.

Fenders that are not attached securely tend to detach and sometimes fall into the water and float away, thus requiring replacement and leading to inconvenience and expense for the riders. It would therefore be desirable to have fenders that can be easily, reliably and securely attached to a small watercraft, such as a PWC.

Some fenders are shaped to conform to the exterior surface of a particular PWC and are therefore not usable with other PWCs. It would be desirable to have versatile fenders that can be used with a wide range of PWCs.

SUMMARY

It is an object of the present technology to ameliorate at least some of the inconveniences present in the prior art.

According to one aspect of the present technology, there is provided a fender for a watercraft having a watercraft body. The watercraft body defines an aperture. The fender has: a fender body made from a flexible material; an anchor distinct from the fender body, the anchor being configured to be inserted in the aperture defined in the watercraft body and for selectively connecting the fender to the watercraft body, the anchor being made from a rigid material; and a link distinct from the fender body and from the anchor, the link connecting the fender body to the anchor, the link being made from a resilient material.

In some embodiments, the fender body is made from a flexible foam.

In some embodiments, the rigid material is stiffer than the resilient material; and the resilient material is stiffer than the flexible foam.

In some embodiments, the flexible foam is a closed-cell foam.

In some embodiments, the flexible foam is an ethylene-vinyl acetate (EVA) foam.

In some embodiments, the flexible foam is a cross-linked foam.

In some embodiments, the resilient material is rubber.

In some embodiments, the rigid material is plastic.

In some embodiments, the link extends through the fender body.

In some embodiments, the fender body defines a passage. The link has a link body extending in the passage. The link body has a first end connected to the anchor. The link has a flange abutting the fender body. The flange is connected to a second end of the link body. The second end of the link body is opposite the first end of the link body. A portion of the fender body defining the passage is disposed between the anchor and the flange.

In some embodiments, the anchor has: an anchor body configured to be received in the aperture of the watercraft body; and a lock movably connected to the anchor body. The lock has a locked position for connecting the anchor to the watercraft body. The lock has an unlocked position for permitting removal of the anchor body from the aperture in the watercraft body and for permitting insertion of the anchor body in the aperture in the watercraft body.

In some embodiments, the lock has a lever for moving the lock between the locked position and the unlocked position. The fender body defines an access aperture providing access to the lever.

In some embodiments, the lock has at least one cam connected to and movable with the lever. The anchor body is disposed between the lever and the at least one cam.

In some embodiments, the fender body has a generally C-shaped cross-section.

In some embodiments, the fender body has: a middle portion; an upper portion extending upward and in a first direction laterally from a top of the middle portion; and a lower portion extending downward in the first direction laterally from a bottom of the middle portion. The upper portion extends over the anchor. The lower portion extends under the anchor.

In some embodiments, the rigid material has a greater hardness than the resilient material; and the resilient material a greater hardness than the flexible material.

According to another aspect of the present technology, there is provided a watercraft having: a watercraft body, the watercraft body defining an aperture; and a fender selectively connected to the watercraft body. The fender has: a fender body made from a flexible material; an anchor distinct from the fender body, the anchor being inserted in the aperture defined in the watercraft body and selectively connecting the fender to the watercraft body, the anchor being made from a rigid material; and a link distinct from the fender body and from the anchor, the link connecting the fender body to the anchor, the link being made from a resilient material.

In some embodiments, the fender body abuts the watercraft body; the link is in tension; and the fender body is at least partially compressed by the link against the watercraft body.

In some embodiments, the fender body is made from a flexible foam.

In some embodiments, the fender body defines a passage. The link has a link body extending in the passage. The link body has a first end connected to the anchor. The link has a flange abutting the fender body. The flange is connected to a second end of the link body. The second end of the link body is opposite the first end of the link body. A portion of the fender body defining the passage is disposed between the watercraft body and the flange.

In some embodiments, the anchor has: an anchor body received in the aperture of the watercraft body; and a lock movably connected to the anchor body. The lock has a locked position connecting the anchor to the watercraft body. The lock has an unlocked position permitting removal of the anchor body from the aperture in the watercraft body and permitting insertion of the anchor body in the aperture in the watercraft body.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example "A and/or B" is to be taken as specific disclosure of each of (i) A, (ii) B and (iii) A and B, just as if each is set out individually herein.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft steered straight-ahead in a neutral trim position and being at rest in calm water.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
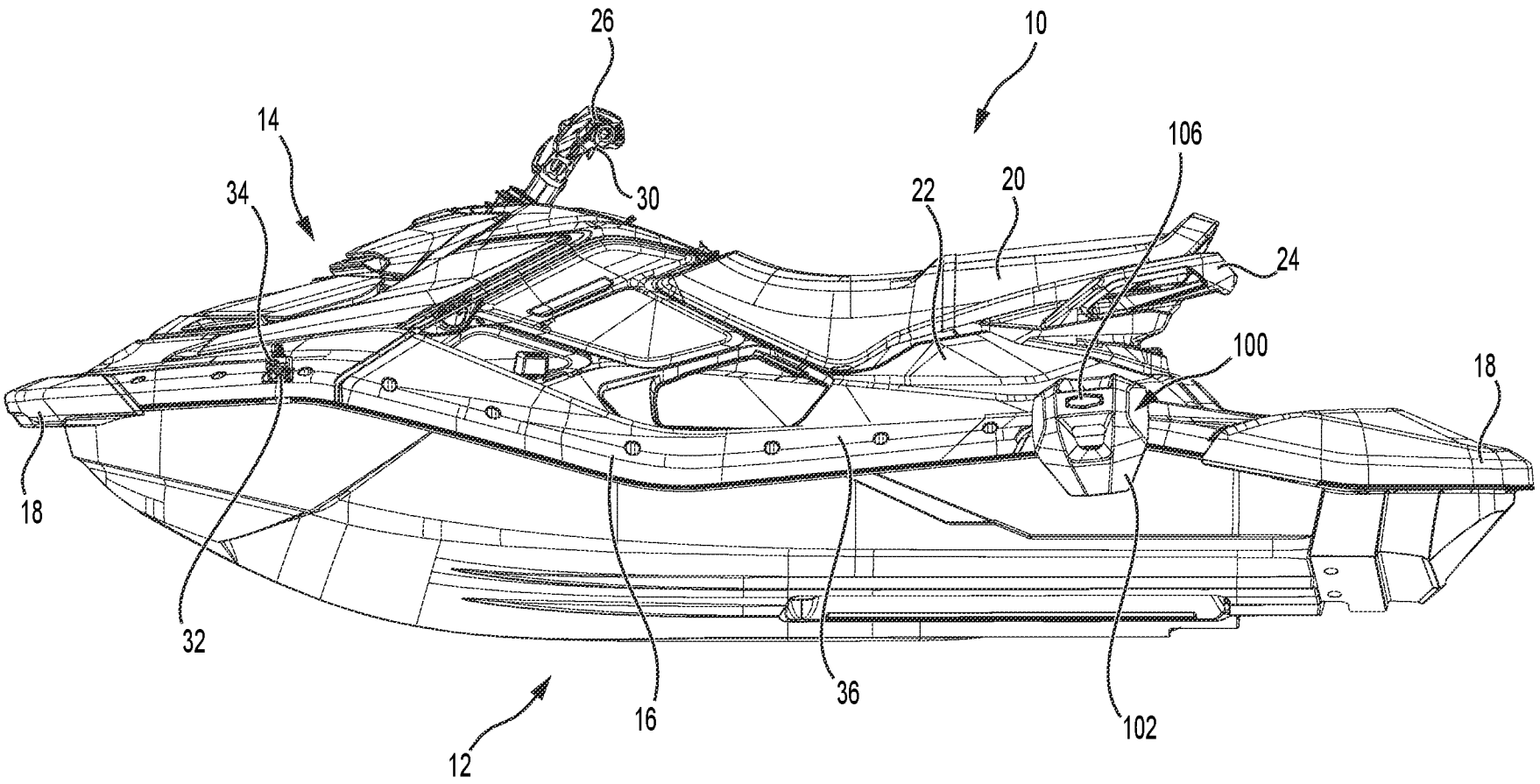
FIG. 1 is a left side elevation view of a personal watercraft having a fender.
Figure 2:
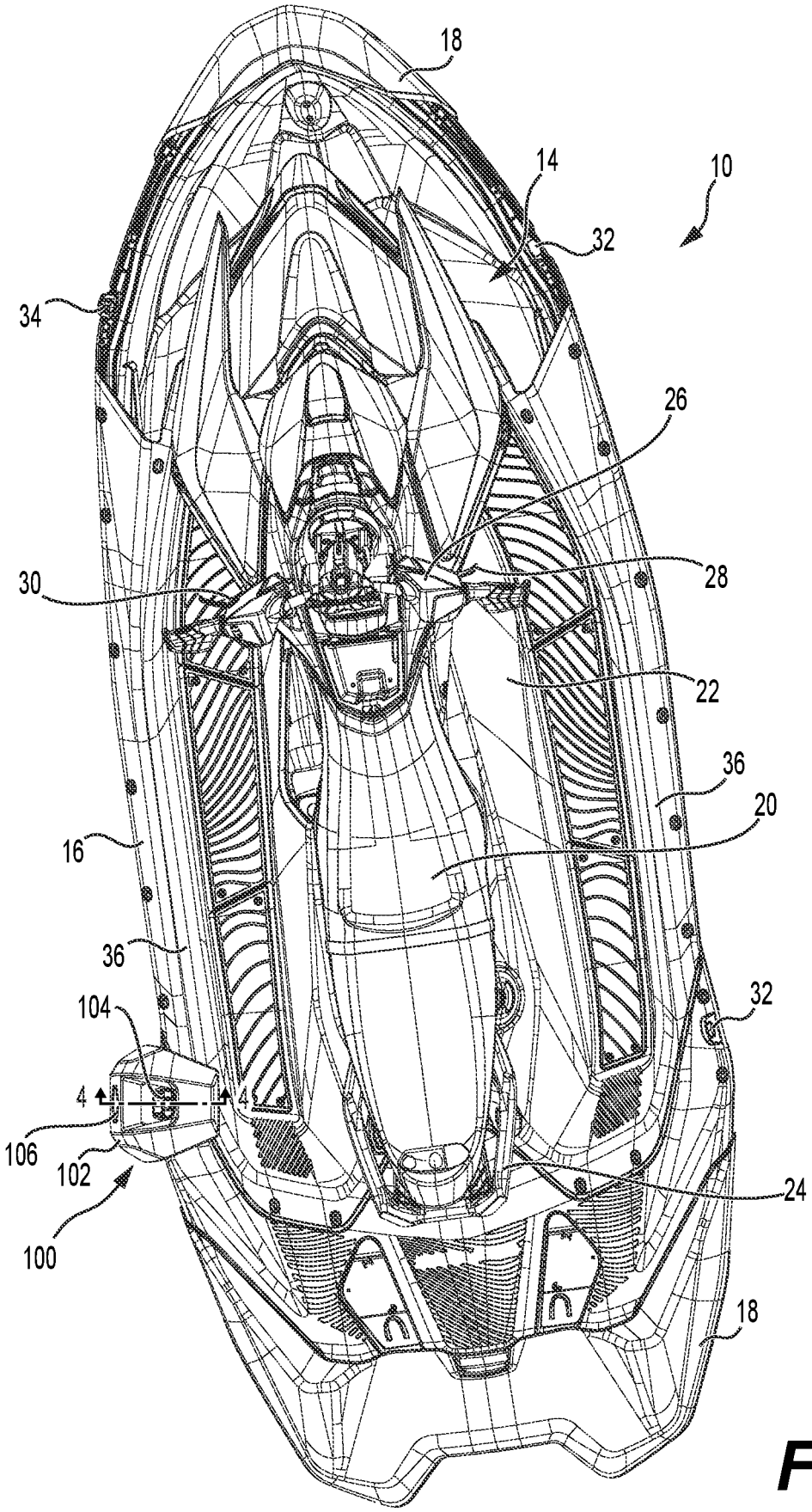
FIG. 2 is a perspective view taken from a top, right side of the personal watercraft of FIG. 1.
Figure 3:
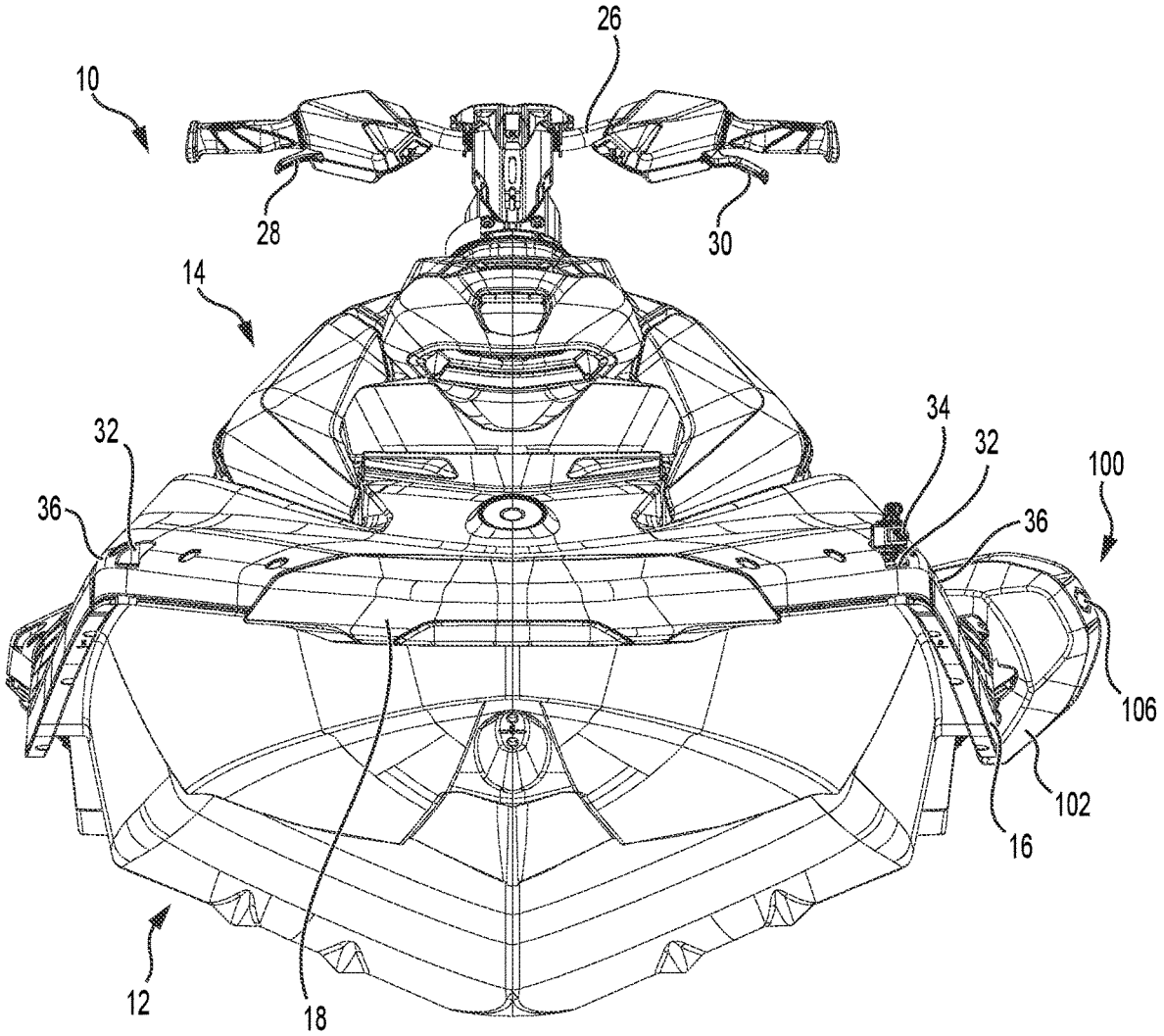
FIG. 3 is a front elevation view of the personal watercraft of FIG. 1.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

The present technology will be described with reference to a personal watercraft 10. It is contemplated that aspects of the present technology could be used in watercraft of another type, such as a motor launch or a pinnace for example.

FIGS. 1 to 4 illustrate the personal watercraft 10. The personal watercraft 10 has a watercraft body made of two main parts. These parts are the hull 12 and the deck 14, which is disposed on the hull 12. The hull 12 buoyantly supports the watercraft 10 in the water. The deck 14 is designed to accommodate a driver and two passengers. It is contemplated that in alternative embodiments, the deck 14 could accommodate only the driver, the driver and one passenger, or the driver and more than two passengers. The hull 12 and deck 14 are joined together by fasteners, more particularly screws. Adhesive and other types of fasteners, such as bolts or rivets may also be used to join the hull 12 to the deck 14. The portions of the watercraft 10 where the hull 12 and the deck 14 joined form an outwardly extending flange 16. Bumpers 18 cover the front and rear portions of the flange 16. The volume created between the hull 12 and the deck 14 is known as the motor compartment. The motor compartment accommodates the engine (not shown) as well as the muffler, exhaust pipe, gas tank, electrical system (battery, electronic control unit, etc.), air box, storage bins and other elements required by or desired for the watercraft 10. In an alternative embodiment, the motor compartment may alternatively accommodate an electric motor, batteries, and associated components instead of the previously mentioned component should the watercraft 10 be an electric personal watercraft 10.

The deck 14 has a centrally positioned straddle-type seat 20 placed on top of a pedestal 22 to accommodate a rider in a straddling position. A grab handle 24 is provided between the pedestal 22 and the straddle-type seat 20 at the rear of the straddle-type seat 20 to provide a handle onto which a passenger may hold on. The seat 20 is removably attached to the pedestal 22 by a hook and tongue assembly (not shown) at the front of the seat 20 and by a latch assembly (not shown) at the rear of the seat 20, or by any other known attachment mechanism. The seat 20 covers a motor access opening (not shown), defined by a top portion of the pedestal 22, which provides access to the engine (not shown).

The engine drives a jet propulsion unit (not shown) for propelling the watercraft 10. The jet propulsion unit includes a steering nozzle (not shown) for redirecting a jet of water expelled from the jet propulsion unit. The steering nozzle is operatively connected to a handlebar 26 provided forward of the seat 20. A throttle lever 28 provided on a right side of the of the handlebar 26 controls an operation of the engine, and thereby a speed of the watercraft 10. A reverse lever 30 provided on a left side of the handlebar 26 controls an operation of a reverse gate (not shown) operatively connected to the jet propulsion unit for reversing a direction of travel of the watercraft 10. In some embodiments, in addition to controlling operation of the reverse gate, the reverse lever 30 simultaneously controls operation of the engine in order to brake and reverse the watercraft 10.

The flange 16 defines two apertures 32 on each side of the watercraft 10. Each aperture 32 extends vertically and is shaped to receive an accessory. In the present embodiment, each aperture 32 has an hexagonal shape as viewed from above, but other shapes are contemplated. Examples of accessories that can be received in the apertures 32 include, but are not limited to, fishing rod holders, wakeboard racks, and a camera. In the present embodiment, an accessory holder 34 is received in the front left aperture 32. The accessory holder 34 can be used to attach a camera (not shown) to the watercraft 10. The accessory holder 34 has a lock used having a locked position connecting the accessory holder 34 to the watercraft 10 and an unlocked position permitting removal of the accessory holder 34 from the watercraft 10. The accessory holder 34 could be received in any one of the four apertures 32. In the present embodiment, a fender 100 is received in the rear left aperture 32. The fender 100 could be received in any one of the four apertures 32. Although only one fender 100 is shown in the figures, two fenders 100 would usually be provided on the watercraft 10: one fender 100 in the front aperture 32 of one side of the watercraft 10 and another fender 100 in the rear aperture 32 on the same side of the watercraft 10. On the left and right sides of the watercraft 10, portions of the deck 14 adjacent to the flange 16 and extending upward from the flange 16 define gunnels 36. It is contemplated that one or more apertures 32 could be defined in the gunnels 36 or in other parts of the deck 14.

Figure 4:
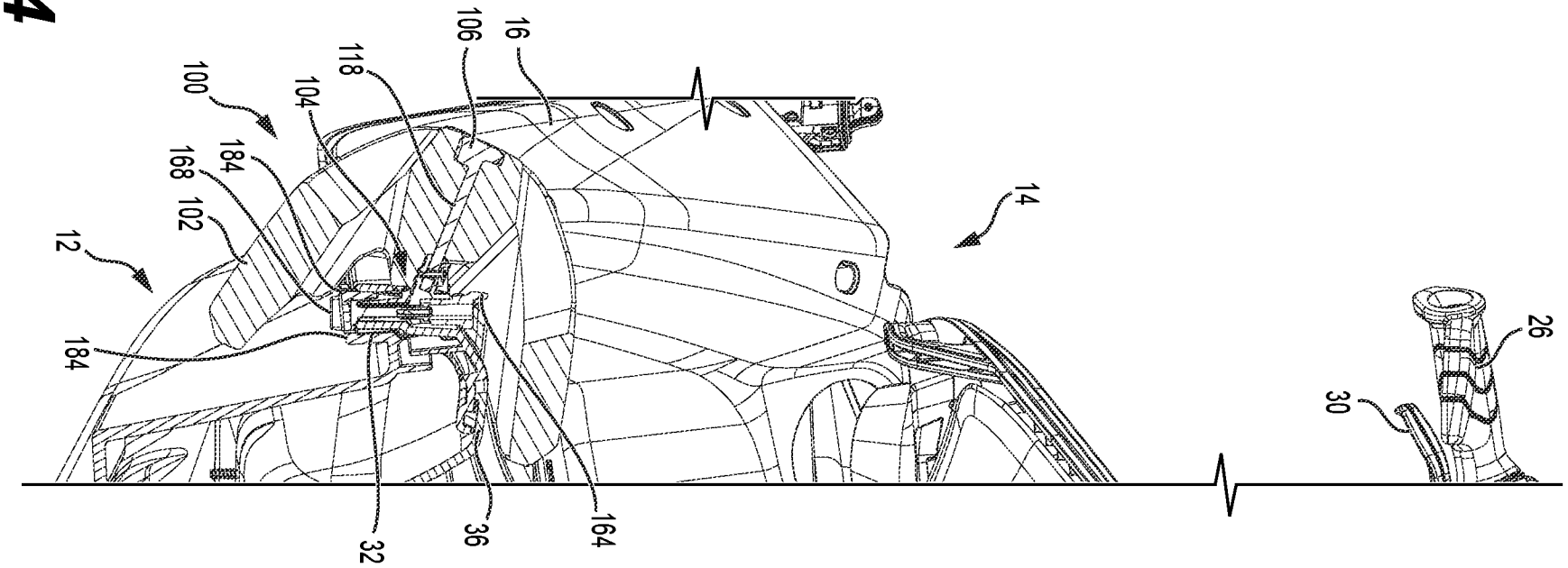
FIG. 4 is a cross-sectional view of the personal watercraft of FIG. 1, taken through line 4-4 of FIG. 2.

Turning now to FIGS. 4 to 14, the fender 100 will be described in more detail. In the description of the fender 100 provided below, terms related to spatial orientation are in reference to the fender 100 being installed on a left side of the watercraft 10 as shown in FIGS. 1 to 4. The fender 100 has a fender body 102, an anchor 104 and a link 106. The fender body 102, the anchor 104 and the link 106 are all distinct from each other. These three physically separate components are assembled as described below to form the fender 100. The anchor 104 is configured to be inserted in any one of the apertures 32 of the watercraft 10 and for selectively connecting the fender 100 to the watercraft 10 as seen in FIG. 4. The link 106 connects the fender body 102 to the anchor 104. As shown in FIG. 4, when the anchor 104 is inserted in the aperture 32 and connects the fender 100 to the watercraft 10, the fender body 102 extends under the flange 16 extends toward the side of the hull 12, covers the portion of the flange 16 with which it is longitudinally aligned, and extends over and abuts the gunnel 36. The fender 100 helps protect from damage caused by collisions, such as collisions with a dock or another boat when the watercraft 10 is at rest. Although the fender 100 can be installed and removed relatively easily, it is contemplated that the fender 100 can remain installed on the watercraft 10 even when the watercraft 10 is in use. The construction of the fender 100 allows it to remain attached to the watercraft 10 even when the fender 100 comes in contact with water while the watercraft 10 is operating at speed. The flexibility of the anchor body 102, the rigidity of the connection provided by the anchor 104, and the resiliency of the link 106 are factors that make this possible.

Figure 9:
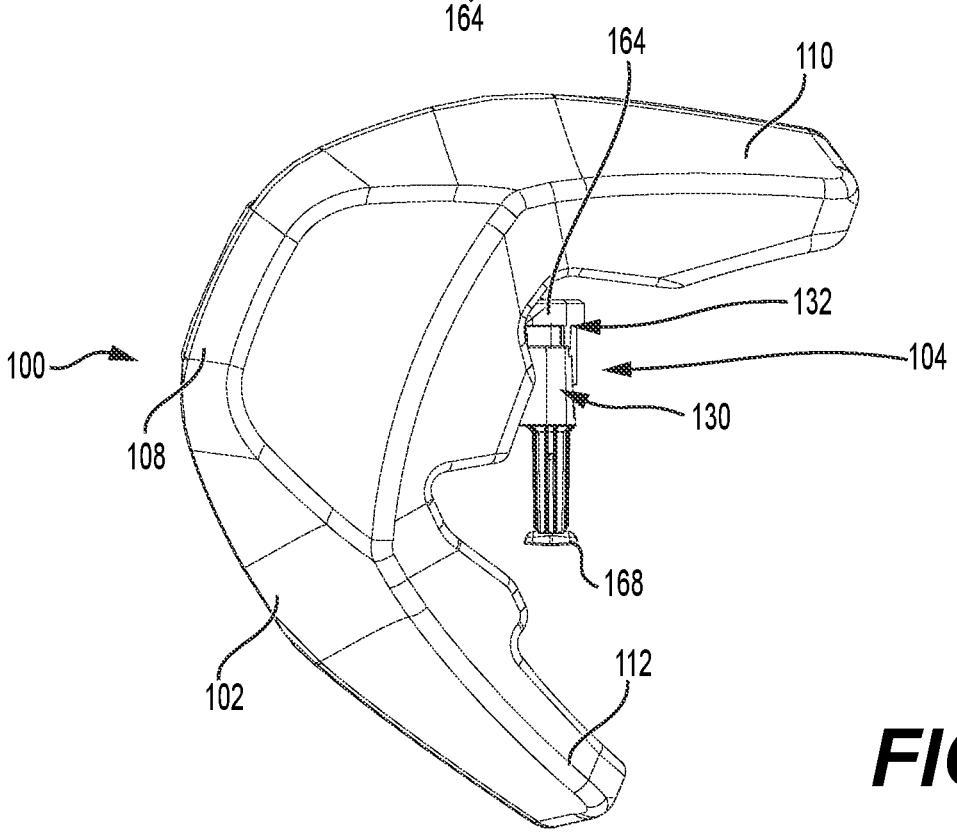
FIG. 9 is a rear view of the fender of FIG. 5, with the lock in the locked position.
Figure 11:
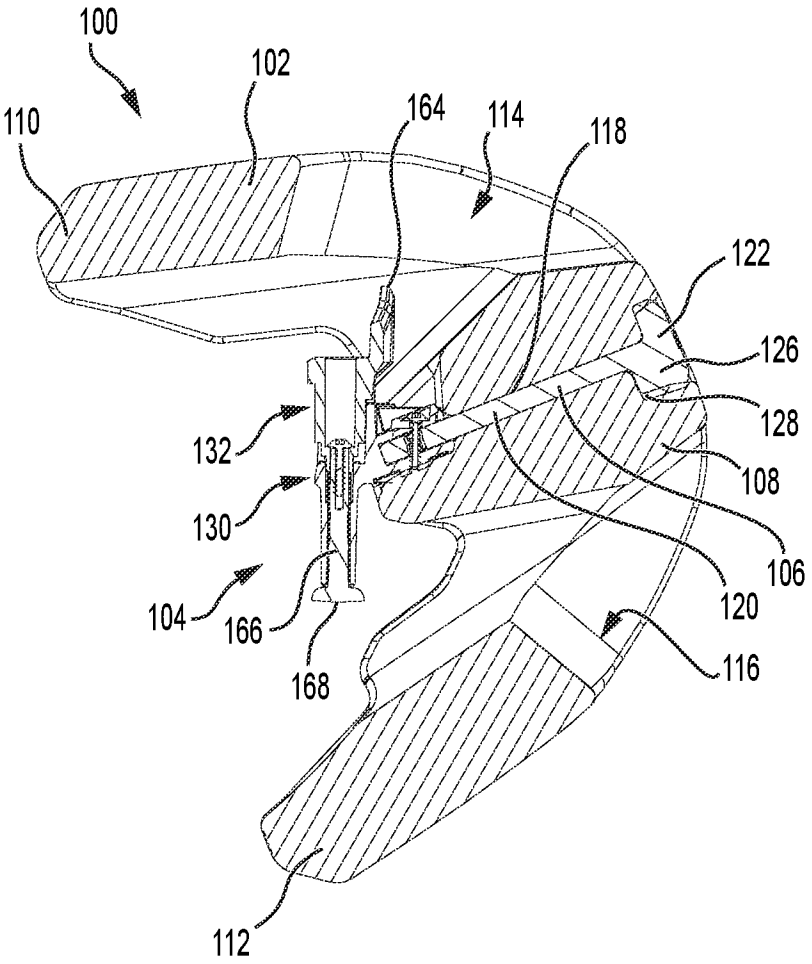
FIG. 11 is a cross-sectional view of the fender of FIG. 5, taken through line 11-11 of FIG. 10, with the lock in the locked position.
Figure 10:
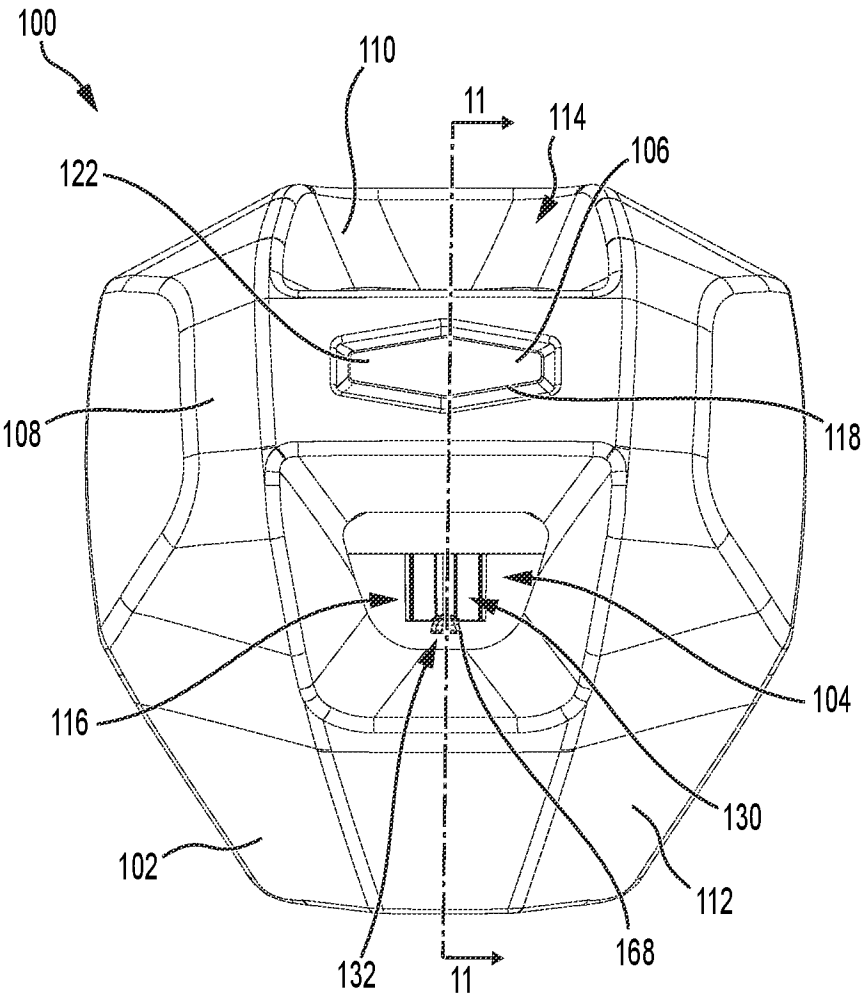
FIG. 10 is a left side view of the fender of FIG. 5, with the lock in the locked position.

The fender body 102 has a middle portion 108, an upper portion 110 and a lower portion 112. The upper portion 110 extends upward and rightward from a top of the middle portion 108. The lower portion 112 extends downward and rightward from a top of the middle portion 108. As such, as seen in FIG. 11, the fender body 102 has a generally C-shaped cross-section. As can be seen in FIGS. 9 and 11, the upper portion 110 extends over the anchor 104 and the lower portion 112 extends under the anchor 104. The upper and lower portions 110, 112 taper as they extend away from the middle portion 108. The middle and upper portions 108, 110 define an access aperture 114 providing access to a top of the anchor 104 when the fender 100 is installed on the watercraft 10. It is contemplated that in some embodiments, the aperture 114 could be omitted. In such embodiments, it is contemplated that the top of the anchor 104 could be accessed when the fender 100 is installed on the watercraft 10 from a front and/or a back of the fender body 10 by one or more passages defined by the fender body 102 and/or by lifting the upper portion 110. The middle and lower portions 108, 112 define an aperture 116. It is contemplated that in some embodiments, the aperture 116 could be omitted. It is contemplated that the fender body 102 could have a different shape.

Figure 5:
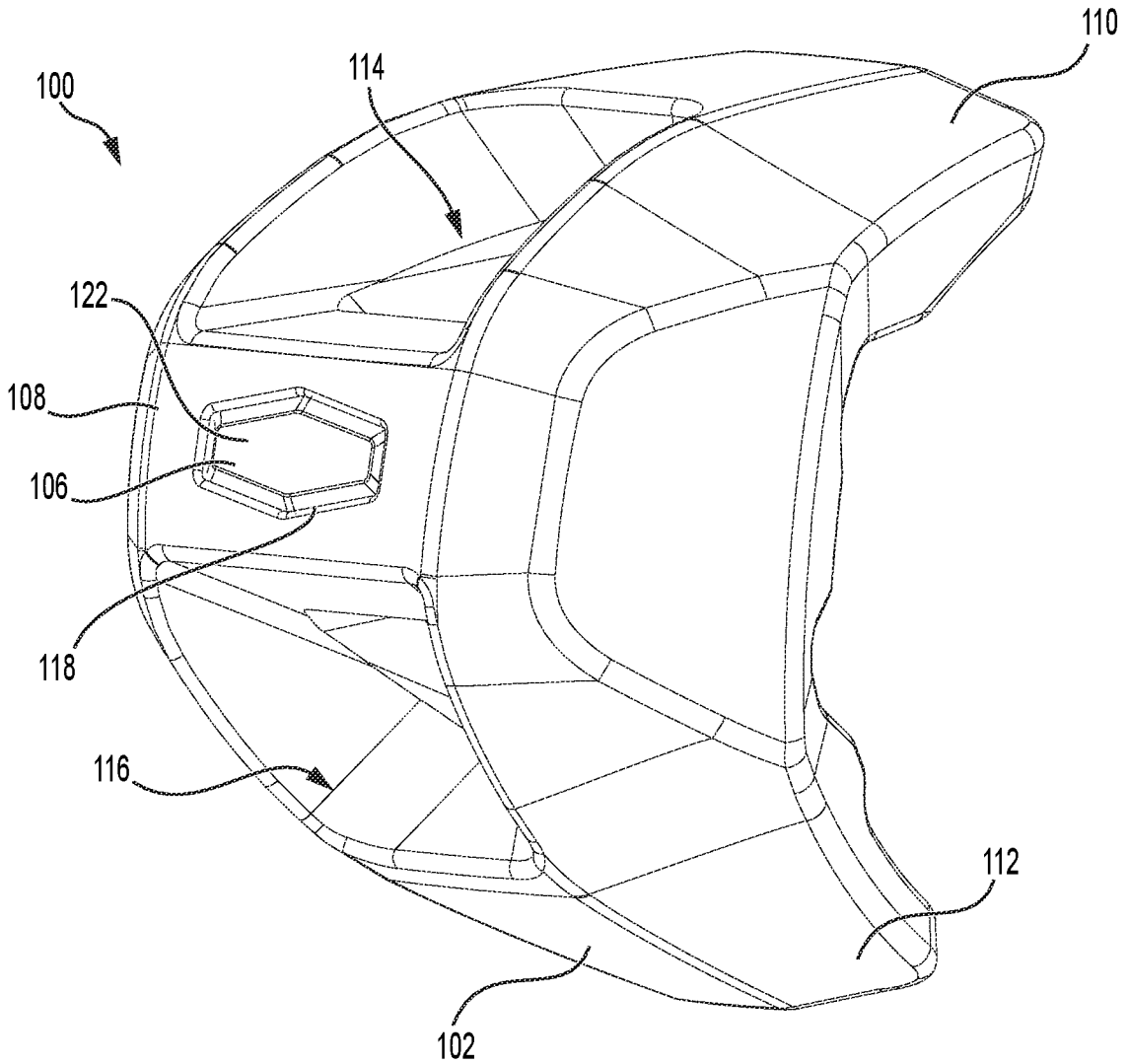
FIG. 5 is a perspective view, taken from a rear, left side, of the fender of FIG. 1.
Figure 12:
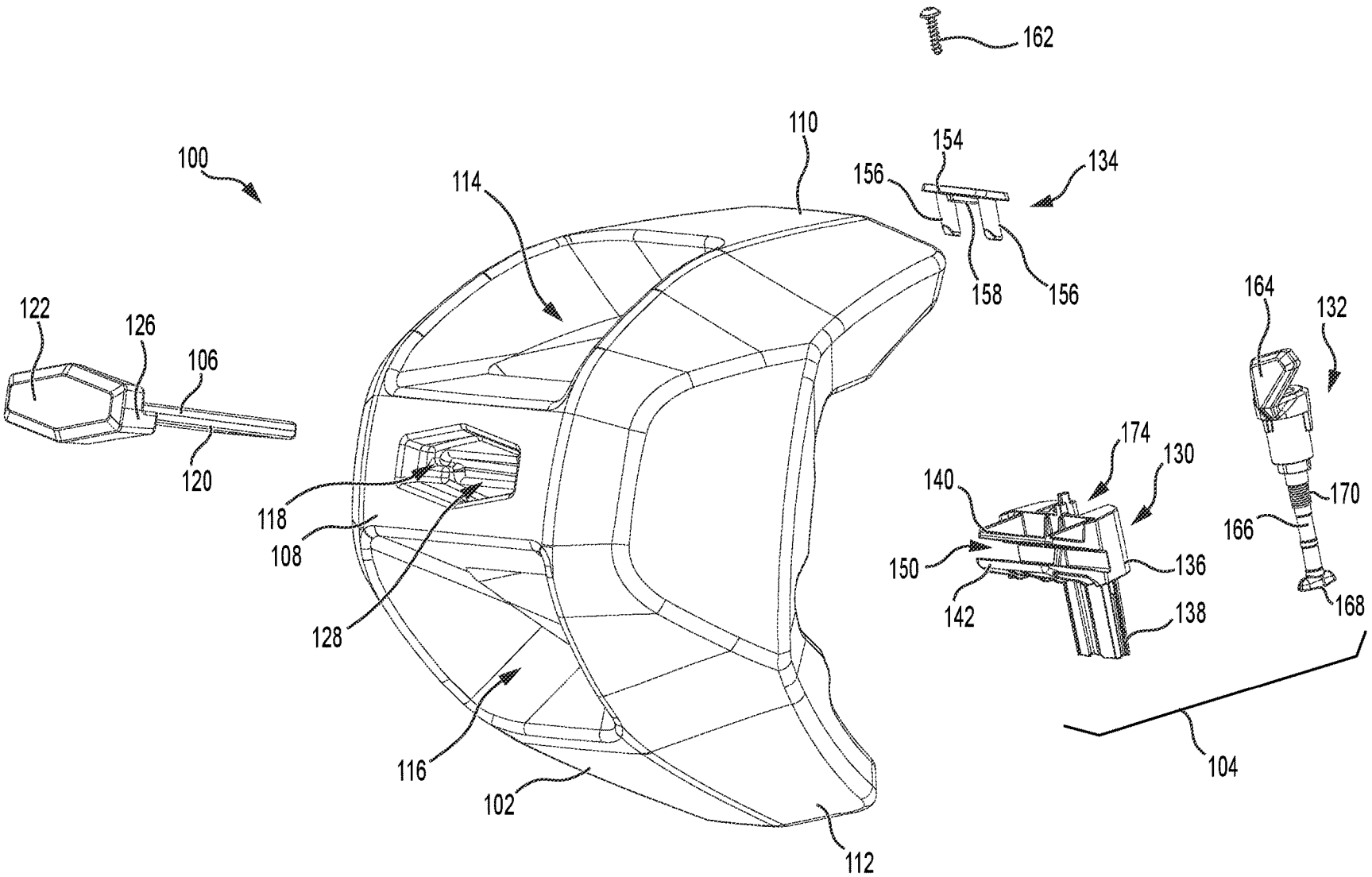
FIG. 12 is an exploded perspective view, taken from a rear, left side, of the fender of FIG. 5, with the lock in the locked position.

The middle portion 108 of the fender body 102 defines a passage 118 that extend laterally therethrough. The passage 118 extends diagonally such that a laterally outward end of the passage 118 is vertically higher than a laterally inward end of the passage 118. The laterally outward end of the passage 118 is enlarged and shaped to receive an end of the link 106 therein as seen in FIGS. 5, 11 and 12. In the present embodiment, the laterally outward end of the passage 118 has a hexagonal shape. The central portion of the passage 118 has a rectangular cross-section. The laterally inward end of the passage 118 is enlarged to receive a connection between the link 106 and the anchor 104 as seen in FIG. 11.

The fender body 108 is made from a flexible material to allow the fender body 108 to absorb the impacts it could experience during use. In some embodiments, the flexible material is a flexible foam. In some embodiments, the flexible foam is a closed-cell foam, thereby allowing the fender 100 to float in water should the fender 100 be accidentally dropped in the water. In some embodiments, the flexible foam is an ethylene-vinyl acetate (EVA). In some embodiments, the flexible foam is a cross-linked foam. In some embodiments, the flexible foam is a flexible foam having two or more of the characteristics listed above. In some embodiments, the flexible foam is a flexible foam having all of the characteristics listed above, such as XL Extralight® foam for example. In some embodiments, the flexible foam is a flexible foam having a hardness of 23+/−3 on the Shore A scale.

Figure 13:
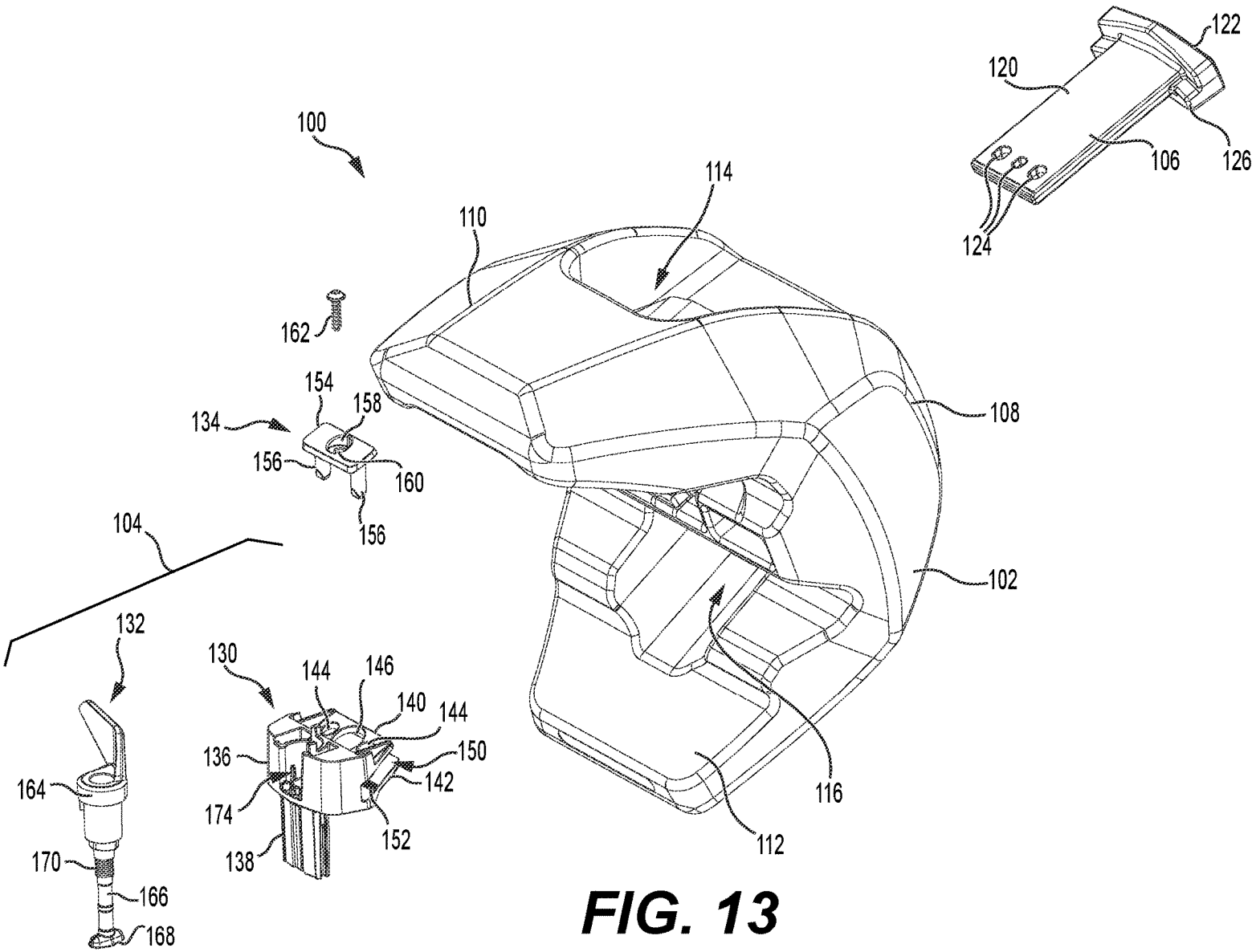
FIG. 13 is an exploded perspective view, taken from a front, right side, of the fender of FIG. 5, with the lock in the locked position.

As best seen in FIGS. 11 to 13, the link 106 has a link body 120 and a flange 122 connected to a laterally outward end of the link body 120. The laterally inward end of the link body 120 defines three apertures 124 for connecting the link 106 to the anchor 104 as will be described in more detail below. The link 106 is inserted in the passage 118 of the fender body 102 so as to extend through the fender body 102.

The flange 122 has a hexagonal shape that is received in the hexagonal laterally outward end of the passage 118. It is contemplated that the flange 122 could have another shape, in which case the laterally outward end of the passage 118 would have a corresponding shape or a different shape that is large enough to receive the flange 122 therein. It is contemplated that in some embodiments, the laterally outward end of the passage 118 could not be enlarged, such that the flange 122 could not be received in the passage 118. In such embodiment, the flange 122 would not be recessed in the fender body 102 and would instead abut a laterally outer surface of the fender body 102. The flange 122 defines a step 126 that is received in a step 128 defined in the enlarged portion of the passage 118. This helps ensure that the link 106 is inserted in the proper orientation (i.e., correct side up) in the passage 118.

The link body 120 has generally rectangular cross-section. The link body 120 extends in the passage 118. It is contemplated that the cross-section of the link body 120 could have another shape, in which case the central portion of the passage 118 would have a corresponding shape or a different shape that is large enough to receive the link body 120 therein.

The link 106 is made from a resilient material. As such, the link 106 can be deformed and returns to its original shape. The resilient material forming the link 106 is stiffer than the flexible foam forming the fender body 102. In some embodiments, the resilient material is rubber, and more specifically synthetic rubber such as ethylene propylene diene monomer (EPDM) rubber, but other materials are contemplated. In some embodiments, the resilient material has a hardness of 60+/−5 on the Shore A scale. With the link 106 inserted in the passage 118 of the fender body 102 and with the anchor 104 connected to the laterally inward end of the link 106, a portion of the fender body 102 defining the passage 118 is disposed laterally between the anchor 104 and the flange 122 as can be seen in FIG. 11. The link 106 is sized such that, when the anchor 104 connects the fender 100 to the watercraft 10 as shown in FIG. 4, the link 106 is in tension. As a result, the fender body 102 is partially compressed by the flange 122 of the link 106 against the watercraft body. This helps the fender body 102 to stay in position. The resilient material of the link 106 also allows the fender body 102 to become partially displaced should the fender body come in contact with water when the watercraft 10 is operating at speed and to then return to its intended position.

Figure 14:
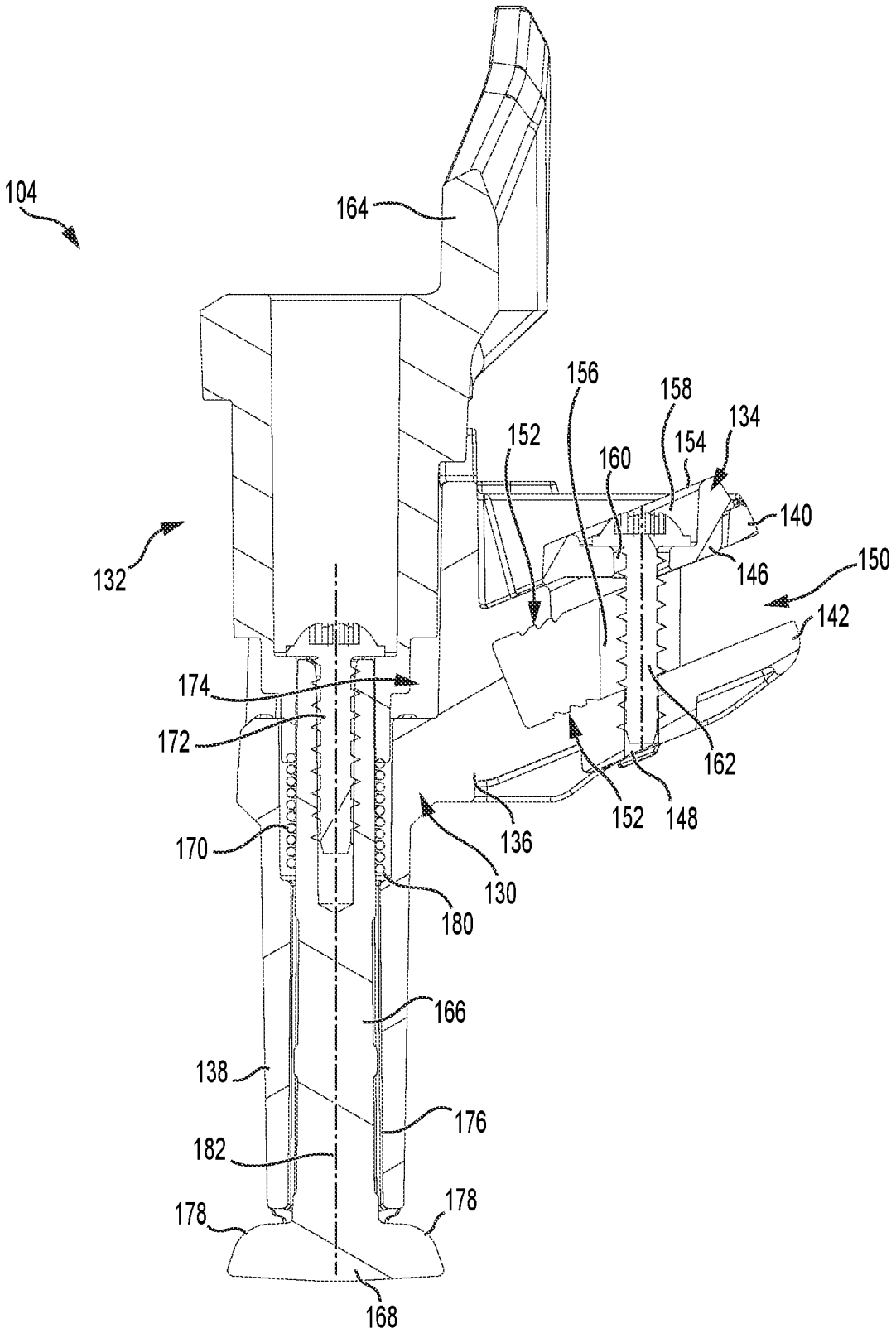
FIG. 14 is a cross-sectional view of the anchor of the fender of FIG. 5, taken through line 11-11 of FIG. 10, with the lock in the locked position.

Turning now to FIGS. 12 to 14, the anchor 104 will be described in more detail. The anchor 104 has an anchor body 130, a lock 132 movably connected to the anchor body 130, and a peg element 134 connecting the link 106 to the anchor 104.

The anchor body 130 has a head portion 136 and a post 138 extending downward from the head portion 136. The post 138 is shaped for being received in the aperture 32 defined in the watercraft body. In the present embodiment the post 138 has a generally hexagonal cross-section. It is contemplated that the cross-section of the post 138 could have a different shape, in which case the aperture 32 would have a corresponding shape. The post 138 and the aperture 32 are shaped such that the post 138 cannot rotate in the aperture 32. The head portion 136 is longer and wider than the post 138, thereby limiting how far down the post 138 can enter the aperture 32. When the anchor 104 is connected to the flange 16 of the watercraft 10 that defines the aperture 32, the head portion 136 abuts a top of the flange 16.

The head portion 136 defines two arm 140, 142. The arms 140, 142 are parallel to each other and extend diagonally upward and outward toward the fender body 102. The upper arm 140 defines two peg apertures 144 and a central aperture 146 between the two peg apertures. Similarly, the lower arm 142 defines two peg apertures (not shown) aligned with the two peg apertures 144 and a central aperture 148 between the two peg apertures and aligned with the central aperture 146. The central aperture 148 has a smaller diameter than the central aperture 146. A space 150 is defined between the arms 140, 142 to receive the laterally inward end of the of the link body 120. A distance between the arms 140, 142 is slightly less than a thickness of the link body 120 to make sure that the link body 120 fits snugly between the arms 140, 142. The arms 140, 142 also define teeth 152 extending in the space 150 to retain the link body 120. Once the laterally inward end of the link body 120 is received in the space 150, the three apertures 124 of the link body 120 are aligned with the apertures 144, 146, 148 defined in the arms 140, 142.

The peg element 134 has a plate 154 from which two pegs 156 extend. A circular recess 158 is defined in the plate 154 and protrudes from a bottom of the plate 154 between the pegs 156. An aperture 160 is defined in the recess 158. With the link body 120 inserted in the space 150, the peg element 134 is mounted by inserting the pegs 156 in the peg apertures 144, the outer apertures 124 of the link body 120 and the peg apertures of the lower arm 142, and by inserting the recess 158 in the central aperture 146 of the upper arm 140. A screw 162 is inserted through the aperture 160 in the recess, the central aperture 124 of the link body 120 and is threaded into the aperture 148 of the lower arm 142, thereby fastening the peg element 134 to the head portion 136 of the anchor body 130. The pegs 156 and the screw 162 inserted in the apertures 124 of the link body 120 connect the link 106 to the anchor 104. By having three connections between the link 106 and the anchor 104 (i.e., two pegs 156 and one screw 162), the rotation of the link 106 about a vertical axis relative to the anchor 104 is limited. It is contemplated that one or both pegs could be replaced by screws. It is also contemplated that only the screw 162, or the screw 162 with one peg 156 could connect the link 106 to the anchor body 104. It is also contemplated that more than two pegs 156 and one screw 162 could be used. It is contemplated that the link 106 could be connected to the anchor body 130 differently.

Figure 6:
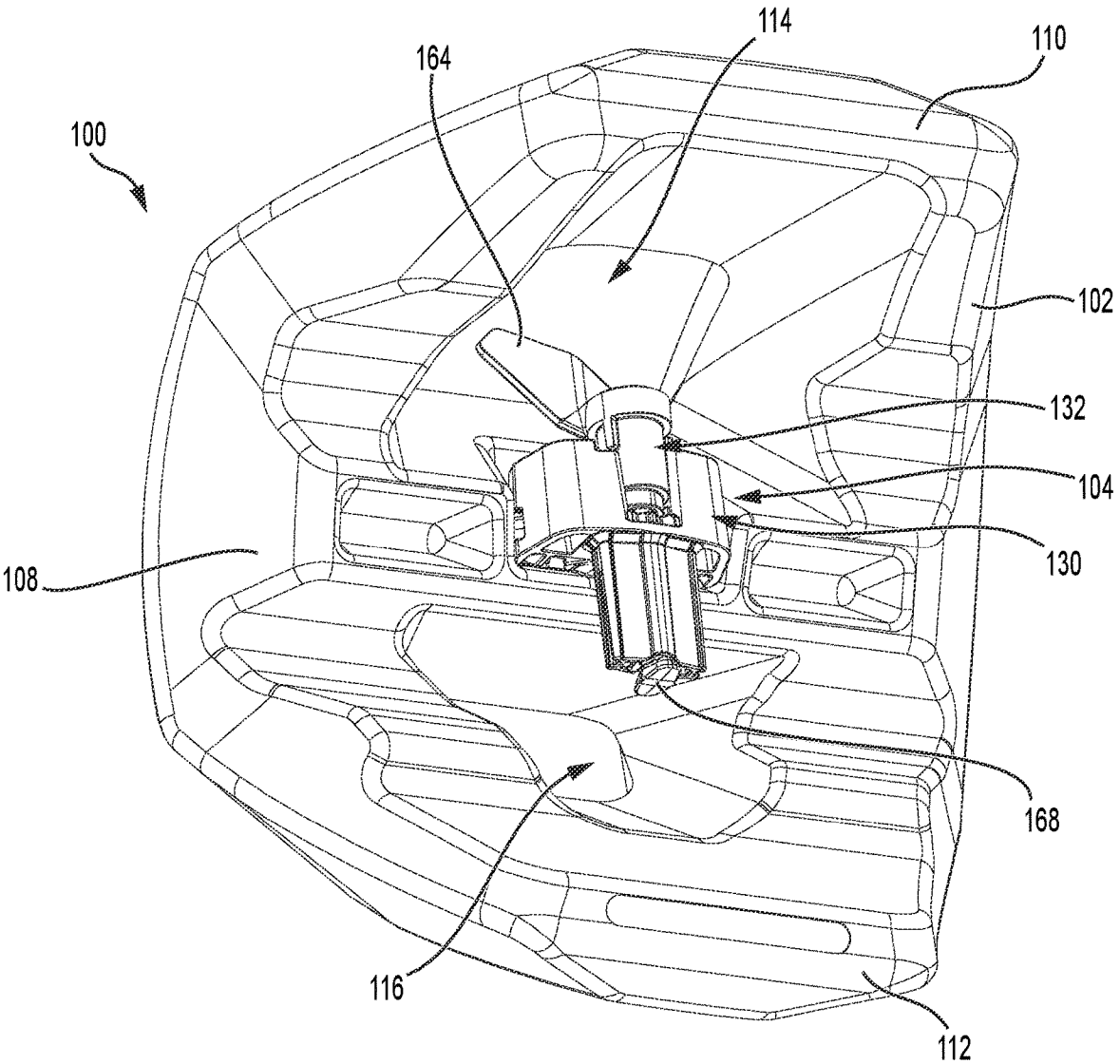
FIG. 6 is a perspective view, taken from a rear, right side, of the fender of FIG. 5, with a lock of an anchor of the fender being in a locked position.
Figure 7:
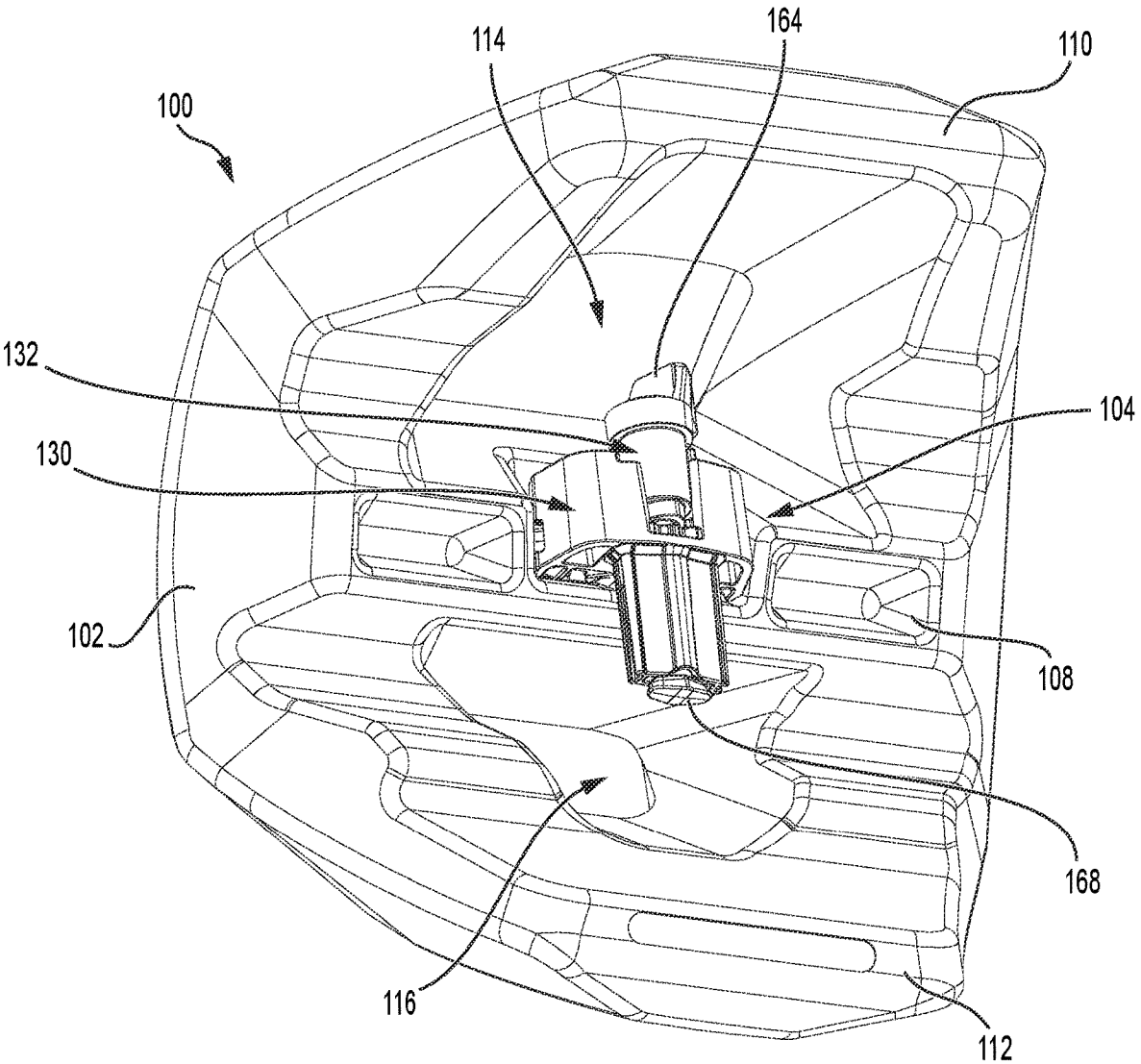
FIG. 7 is a perspective view, taken from a rear, right side, of the fender of FIG. 5, with the lock in an unlocked position.

The lock 132 includes a lever 164, a shaft 166 connected to the lever 164, a cam member 168 connected to the shaft 164, a spring 170 and a screw 172. The lever 164 is received in a recess 174 defined in the head portion 136 of the anchor body 130. The shaft 166 is received in a passage 176 defined in the post 138 of the anchor body 130. The screw 172 fastens the lever 164 to the shaft 166. The cam member 168 is connected to the lower end of the shaft 166. In the present embodiment, the cam member 168 is integrally formed with the shaft 166, but it is contemplated that the cam member 168 could be connected to the shaft differently, such as by a threaded fastener for example. The cam member 168 is disposed below the lower end of the post 138 of the anchor body 130. As such, the post 138 is disposed between the lever 164 and the cam member 168. The cam member 168 is generally hexagonal, as seen in FIGS. 6 and 7, but other shapes are contemplated. The cam member 168 defines two cams 178. The spring 170 is disposed inside the passage 176 around the shaft 166. The spring 166 abuts a step 180 defined in the passage 176 and a lower end of the lever 164 so as to bias the lever 164 away from the post 138. As a result, the cam member 138 is biased toward the lower end of the post 138.

Figure 8:
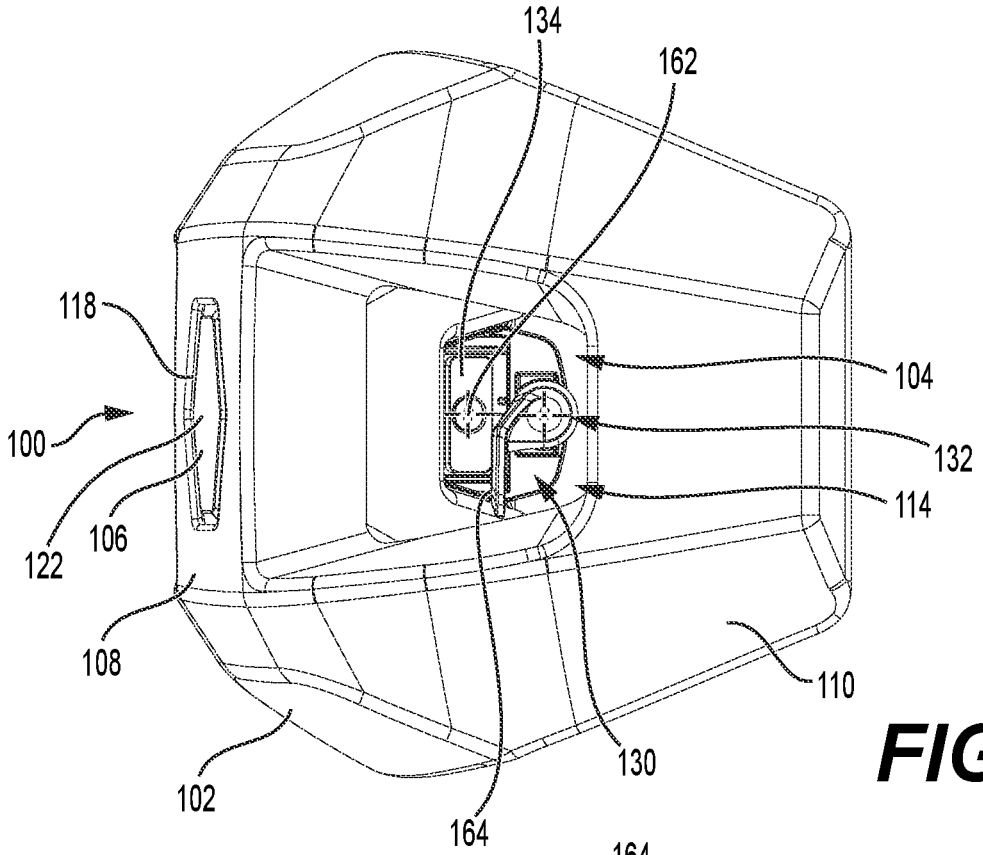
FIG. 8 is a top plan view of the fender of FIG. 5, with the lock in the locked position.

The lever 164 is used to move the lock 132 between a locked position and an unlocked position. The access aperture 114 defined in the fender body 102 permits access to the lever 164 as best seen in FIG. 8. As the lever 164 is turned about a vertical axis 182 corresponding to the longitudinal axis of the shaft 166, the shaft 166 and the cam member 168 turn together with the lever 164 about the axis 182. In the unlocked position shown in FIG. 7, the cam member 168 is contained within the perimeter of the post 138 as viewed from below. Since in the unlocked position the cam member 168 does not protrude longitudinally or laterally from the post 138, the unlocked position of the lock 132 permits insertion of the post 138 of the lock body 130 into the aperture 32 in the watercraft body and permits removal of the post 138 of the lock body 130 from the aperture 32. In the locked position shown in FIGS. 6, 8 to 11 and 14 are turned 90 degrees from their orientations in the unlocked position. As a result, the cam member 168 protrudes laterally from the post 138 as best seen in FIG. 14. When the post 138 is inserted in the aperture 32 and the lock 132 is moved to its locked position, as the cam member 168 rotates, the cams 178 engage downwardly facing surfaces 184 (FIG. 4) adjacent to the lower end of the aperture 32. As a result, the cam member 168, the shaft 166 and the lever 164 move down slightly, thereby compressing the spring 170. The spring 170 thus biases the cams 178 against the surfaces 184, thereby firmly pressing the head portion 136 of the anchor body 130 against the flange 16, thereby connecting the anchor 104 to the watercraft body. Friction between the cams 178 and the surfaces 184 prevent the lock 132 from being easily returned to the unlocked position. In some embodiments, the surfaces 184 define small indentations for receiving the cams 178 when the lock 132 is in the locked position, thereby further helping to prevent the lock 132 from being accidentally returned to the unlocked position. It is contemplated that an anchor that is different from the anchor 104 described above could be used to connect the fender 100 to the watercraft body.

The anchor body 130, the lever 164, the shaft 166 and the cam member 168 are made from a rigid material. More specifically, these components are made from a rigid material that is stiffer than the resilient material of the link 106, such that when the anchor 100 is connected to the watercraft body, the tension in the link 106 compresses the fender body 102, but does not deform the anchor 104, or only minimally deforms the anchor 104. In some embodiment, the anchor body 130, the lever 164, the shaft 166 and the cam member 168 are made from plastic, such as, for example, acrylonitrile butadiene styrene (ABS), high-density polyethylene (HDPE), polycarbonate (PC), thermoplastic polyurethane (TPU), and PA66 GF33 glass fiber reinforced nylon. In some embodiments, the rigid material has a hardness of 120+/−5 on the Rockwell scale. The rigid material has a greater hardness than the resilient material of the link 106, and the resilient material of the link 106 has a greater hardness than the fender body 102. It is contemplated that other materials could be used for the rigid material, such as stainless steel, aluminum or composite materials. It is contemplated that the anchor body 130, the lever 164, the shaft 166 and the cam member 168 could be made from different rigid materials. The spring 170 is made from stainless steel, but other metals, plastics and composites are contemplated.

Modifications and improvements to the above-described embodiments of the present invention may become apparent to those skilled in the art. The foregoing description is intended to be exemplary rather than limiting. The scope of the present technology is therefore intended to be limited solely by the appended claims.

What is claimed is:

1. A fender for a watercraft having a watercraft body, the watercraft body defining an aperture, the fender comprising:
- a fender body made from a flexible material;
- an anchor distinct from the fender body, the anchor being configured to be inserted in the aperture defined in the watercraft body and for selectively connecting the fender to the watercraft body, the anchor being made from a rigid material; and
- a link distinct from the fender body and from the anchor, the link connecting the fender body to the anchor, the link being made from a resilient material.

2. The fender of claim 1, wherein the fender body is made from a flexible foam.

3. The fender of claim 2, wherein:
- the rigid material is stiffer than the resilient material; and
- the resilient material is stiffer than the flexible foam.

4. The fender of claim 2, wherein the flexible foam is a closed-cell foam.

5. The fender of claim 2, wherein the flexible foam is an ethylene-vinyl acetate (EVA) foam.

6. The fender of claim 2, wherein the flexible foam is a cross-linked foam.

7. The fender of claim 2, wherein the resilient material is rubber.

8. The fender of claim 2, wherein the rigid material is plastic.

9. The fender of claim 1, wherein the link extends through the fender body.

10. The fender of claim 9, wherein:
- the fender body defines a passage;
- the link has a link body extending in the passage;
- the link body has a first end connected to the anchor;
- the link has a flange abutting the fender body;
- the flange is connected to a second end of the link body, the second end of the link body being opposite the first end of the link body; and
- a portion of the fender body defining the passage is disposed between the anchor and the flange.

11. The fender of claim 1, wherein the anchor comprises:
- an anchor body configured to be received in the aperture of the watercraft body; and
- a lock movably connected to the anchor body,
- the lock having a locked position for connecting the anchor to the watercraft body, and
- the lock having an unlocked position for permitting removal of the anchor body from the aperture in the watercraft body and for permitting insertion of the anchor body in the aperture in the watercraft body.

12. The fender of claim 11, wherein:

the lock has a lever for moving the lock between the locked position and the unlocked position; and the fender body defines an access aperture providing access to the lever.

13. The fender of claim 12, wherein:

the lock has at least one cam connected to and movable with the lever; and the anchor body is disposed between the lever and the at least one cam.

14. The fender of claim 1, wherein the fender body has a generally C-shaped cross-section.

15. The fender of claim 14, wherein:

the fender body has:

a middle portion;

an upper portion extending upward and in a first direction laterally from a top of the middle portion; and a lower portion extending downward in the first direction laterally from a bottom of the middle portion;

the upper portion extends over the anchor; and the lower portion extends under the anchor.

16. The fender of claim 1, wherein:

the rigid material has a greater hardness than the resilient material; and the resilient material has a greater hardness than the flexible material.

17. A watercraft comprising:

a watercraft body, the watercraft body defining an aperture; and a fender selectively connected to the watercraft body, the fender comprising:

a fender body made from a flexible material;

an anchor distinct from the fender body, the anchor being inserted in the aperture defined in the watercraft body and selectively connecting the fender to the watercraft body, the anchor being made from a rigid material; and a link distinct from the fender body and from the anchor, the link connecting the fender body to the anchor, the link being made from a resilient material.

18. The watercraft of claim 17, wherein:

the fender body abuts the watercraft body;

the link is in tension; and the fender body is at least partially compressed by the link against the watercraft body.

19. The watercraft of claim 17, wherein the fender body is made from a flexible foam.

20. The watercraft of claim 17, wherein:

the fender body defines a passage;

the link has a link body extending in the passage;

the link body has a first end connected to the anchor;

the link has a flange abutting the fender body;

the flange is connected to a second end of the link body, the second end of the link body being opposite the first end of the link body; and a portion of the fender body defining the passage is disposed between the watercraft body and the flange.

21. The watercraft of claim 17, wherein the anchor comprises:

an anchor body received in the aperture of the watercraft body; and a lock movably connected to the anchor body, the lock having a locked position connecting the anchor to the watercraft body, and the lock having an unlocked position permitting removal of the anchor body from the aperture in the watercraft body and permitting insertion of the anchor body in the aperture in the watercraft body.

* * * * *